United States Patent [19]

Matsuda et al.

[11] 4,448,559

[45] May 15, 1984

[54] PAPER GUIDE ARRANGEMENT FOR PRINTING APPARATUS

[75] Inventors: Susumu Matsuda; Katuhiko Kawaguchi, both of Shizuoka, Japan

[73] Assignee: Tokyo Electric Co., Ltd., Tokyo, Japan

[21] Appl. No.: 387,238

[22] Filed: Jun. 10, 1982

[30] Foreign Application Priority Data

Jun. 19, 1981 [JP] Japan ..... 56-90786[U]

[51] Int. Cl.[3] ..... B41J 13/04

[52] U.S. Cl. ..... 400/637.4; 400/600.2; 400/600.3; 400/637.1; 400/613.1; 235/58 CF

[58] Field of Search ..... 226/89, 90, 91, 176, 226/177, 181; 400/600, 600.2–600.4, 613.1, 637.1, 639.1, 637.3, 637.4; 101/232; 235/58 CF, 58 P, 60.51

[56] References Cited

U.S. PATENT DOCUMENTS

| | | | |
|---|---|---|---|
| Re. 21,050 | 4/1939 | Crosman | 400/600.3 |
| 1,973,589 | 9/1934 | Watson | 226/176 X |
| 2,963,138 | 12/1960 | Motte et al. | 400/600.3 |
| 3,042,179 | 7/1962 | Stern | 400/600.2 X |
| 3,208,682 | 9/1965 | Pastor et al. | 226/91 X |
| 3,576,283 | 4/1971 | MacDonald, Jr. | 226/176 x |
| 4,029,247 | 6/1977 | Sakariason | 226/90 X |

OTHER PUBLICATIONS

IBM Technical Disclosure Bulletin, "Pressure Roll Actuating Mechanism", by Cutshall et al., vol. 11, No. 6, Nov. 1968, pp. 618–619.

*Primary Examiner*—Edgar S. Burr
*Assistant Examiner*—John A. Weresh
*Attorney, Agent, or Firm*—Frishauf, Holtz, Goodman & Woodward

[57] ABSTRACT

A paper guide arrangement for printing apparatus, includes a platen, a paper supply guide, a paper discharge guide, and a paper supply drive roller disposed at the paper supply guide for rotation by a motor. A paper supply contact roller is movably supported into and out of contact with the paper supply drive roller. A paper discharge drive roller is disposed at the paper discharge guide for rotation by the motor, and a paper discharge contact roller is movably supported into and out of contact with the drive roller. A support member for the paper supply contact roller serves to activate the motor to rotate the supply drive roller when the supply contact roller is brought into rolling contact with the supply drive roller, and to stop the drive of the motor to stop rotation of the supply drive roller when the supply contact roller is removed from the supply drive roller. The support member cooperates with a pivotable member which supports the discharge contact roller, so that the discharge contact roller is urged to retract from the discharge drive roller when the support member is moved to bring the supply contact roller into contact with the supply drive roller.

7 Claims, 4 Drawing Figures

PAPER GUIDE ARRANGEMENT FOR PRINTING APPARATUS

BACKGROUND OF THE INVENTION

This invention relates to apparatus of the kind including a printer, such as an electronic cash register.

A known apparatus of this type comprises a platen, a supply guide for guiding printing paper to the platen, and a discharge guide for guiding the paper from the platen. Pinch roller mechanisms each composed of a drive or feed roller and rolling content rollers are provided for feeding the paper into the supply and discharge guides, respectively. With such an arrangement, it is troublesome to set the paper in the pinch roller mechanisms and the guides. Furthermore, maintenance is relatively difficult.

SUMMARY OF THE INVENTION

The object of this invention is to provide an apparatus of the kind including a printer which facilitates maintenance, and comprises pinch roller mechanisms and guides in which paper is set.

BRIEF DESCRIPTION OF THE DRAWINGS

FIGS. 1 to 4 show an apparatus including a printer according to an embodiment of this invention, in which;

FIG. 1 is a schematic sectional view,

FIG. 2 is a disassembled perspective view showing a discharge guide and discharge-side pinch roller units, FIG. 3 is a disassembled perspective view mainly showing supply-side pinch roller mechanisms and a drive mechanism, and FIG. 4 is a circuit diagram of a drive circuit.

DETAILED DESCRIPTION OF THE PREFERRED EMBODIMENT

There will now be described an apparatus including a printer according to an embodiment of this invention, with reference to the accompanying drawings.

Figure 1:
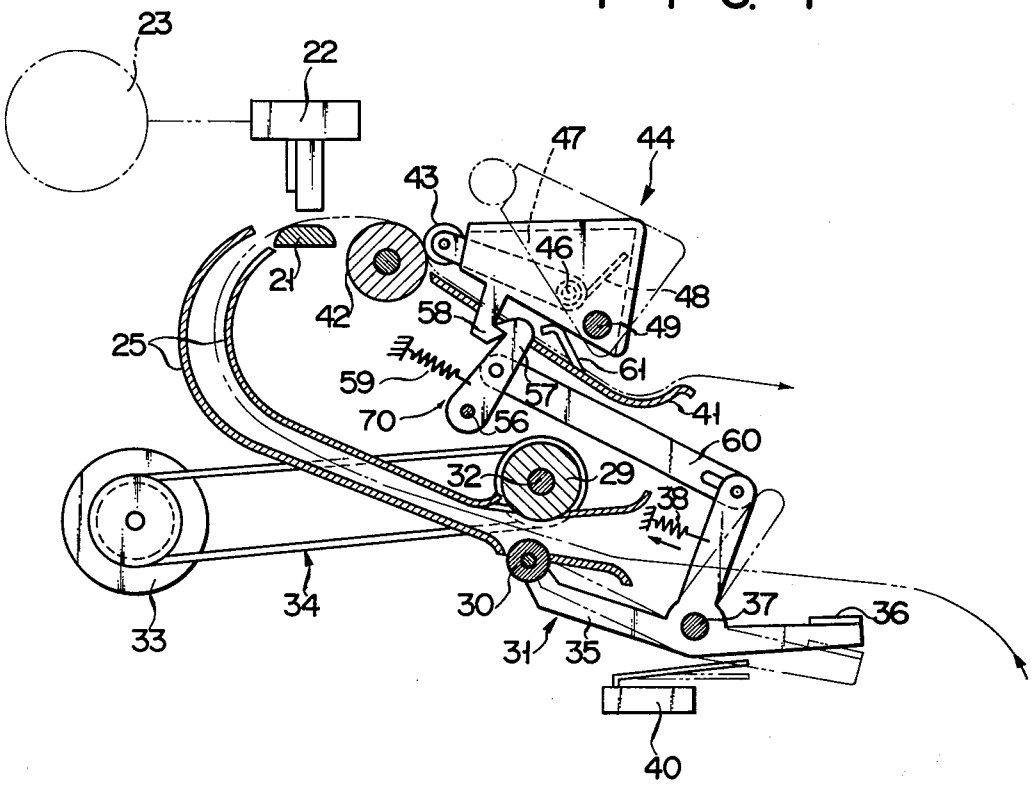
Figure 3:
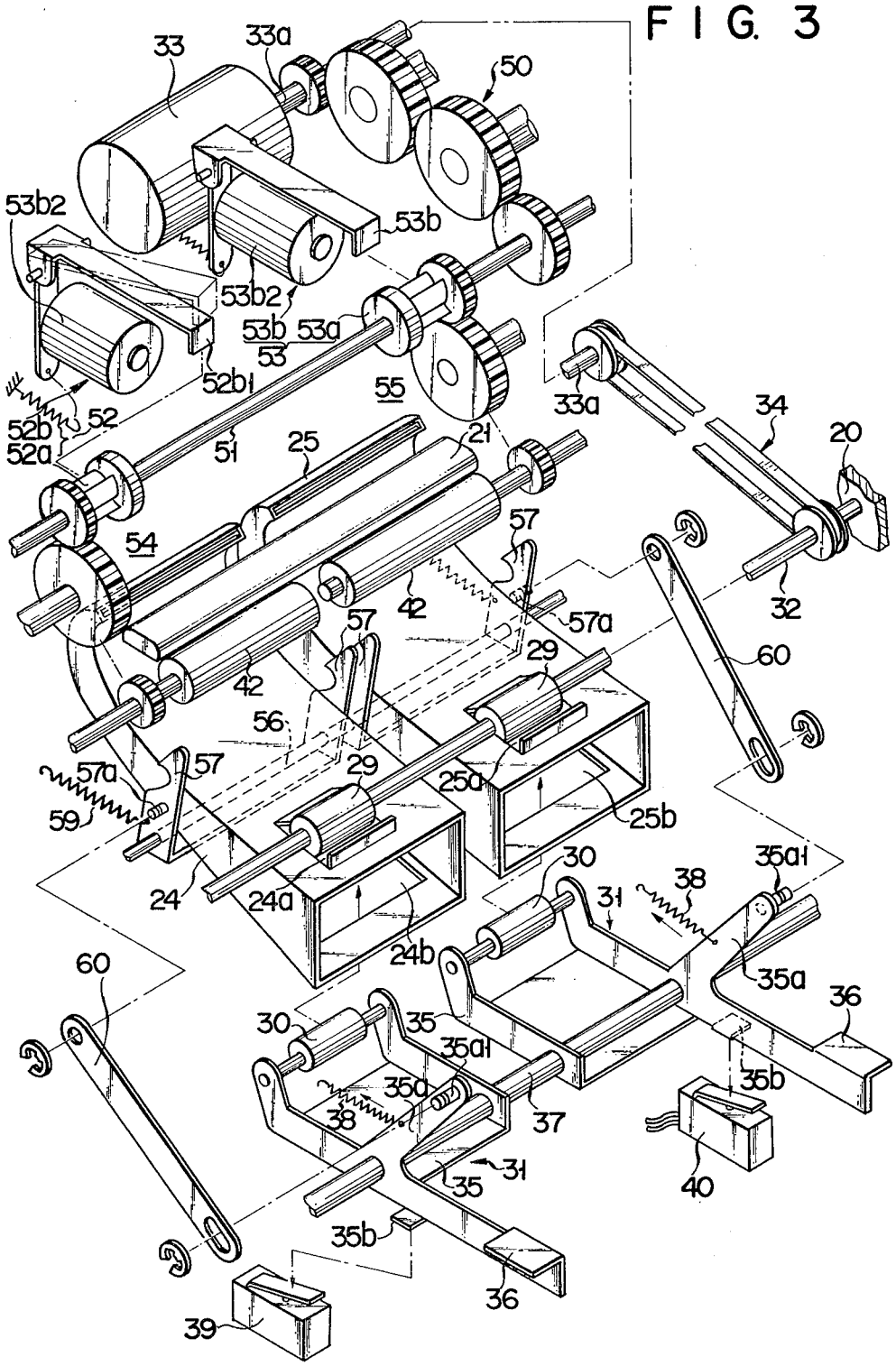

FIG. 1 shows a platen 21 which extends at right angles to the plane of the drawing. Disposed over the platen 21 is a printing head 22 of a dot-printing system which is reciprocated along the length of the platen 21. The head 22 is driven by a head drive motor 23 and a transmission mechanism (not shown) to transmit a driving force from the motor 23 to the head 22. FIG. 3 shows supply guides 24 and 25 for e.g., receipt and journal blank strips, respectively. The supply guides 24 and 25 are arranged side by side. The lower end of each supply guide opens as a blank inlet end, while the upper end opens behind the platen 21. Thus, the supply guides 24 and 25 are arranged angularly so that the blank strips may be led to the platen 21 from behind.

A supply mechanism is disposed on the blank inlet end side of each of the supply guides 24 and 25. The supply mechanism includes a supply-side pinch roller mechanism 31 which includes a supply-side feed roller 29 and a rolling contact roller 30 normally separated from the roller 29 and capable of coming into rolling contact therewith. The lower portions of the feed rollers 29 project into their corresponding supply guides 24 and 25 through openings **24*a* and 25*a* in the upper walls of the guides 24 and 25, respectively. Both rollers 29 are coaxially supported on a common rotating shaft 32 with a given space between them. The shaft 32 is rotatably supported on the side walls of the apparatus housing 20, and is coupled to a drive shaft 33*a* of a motor 33 by means of a transmission mechanism 34 composed of pulleys and a belt, to be rotated by the motor 33. The rolling contact rollers 30 are rotatably supported on the rear end portions of support members 35. Each support member 35 has its front end portion projected beyond the front of the apparatus housing 20, and is provided with an operating portion 36 on its upper surface. The middle portions of both support members 35 are loosely fitted on a common pivot 37 so that the operating portions 36 are rockably supported on the pivot 37. The pivot 37 is fixed to the apparatus housing so as to extend horizontally. Thus, the operating portions 36 can rock relative to the apparatus housing around a horizontal axis. Extending between each operating portion 36 and the apparatus housing is a tension spring 38, whereby the operating portion 36 is urged to rock in the counterclockwise direction as indicated by an arrow in FIG. 3. Openings 24*b* and 25*b* are formed in the lower walls of the supply guides 24 and 25 facing the openings 24*a* and 25*a* in the upper walls, respectively. The upper portions of the rolling contact rollers 30 project into the guides through the openings 24*b* and 25*b*, respectively. The rolling contact rollers 30 are vertically separated from the feed rollers 29 when the support members 35 are urged by the springs 38 to be located in the position indicated by a solid line in FIG. 1. When the support member 35 rocks clockwise by pressing the operating portions 36 to the position indicated by imaginary lines in FIG. 1 against the urging force of the spring 38, the rolling contact roller 30 is brought into rolling contact with the feed roller 29 within the guide. Each support member 35 has a link portion 35*a* protruding upward from the middle portion and a horizontally projected switch interlocking portion 35*b*. Normally open switches 39 and 40 formed of microswitches are located near both switch interlocking portions 35*b*. The switches 39 and 40 are pressed by their corresponding interlocking portions 35*b* to be closed when their corresponding support members 35 are rocked clockwise. The switches 39 and 40 are connected with the motor 33 as shown in FIG. 4 so that the motor 33** may be rotated when the switches are closed.

Figure 4:
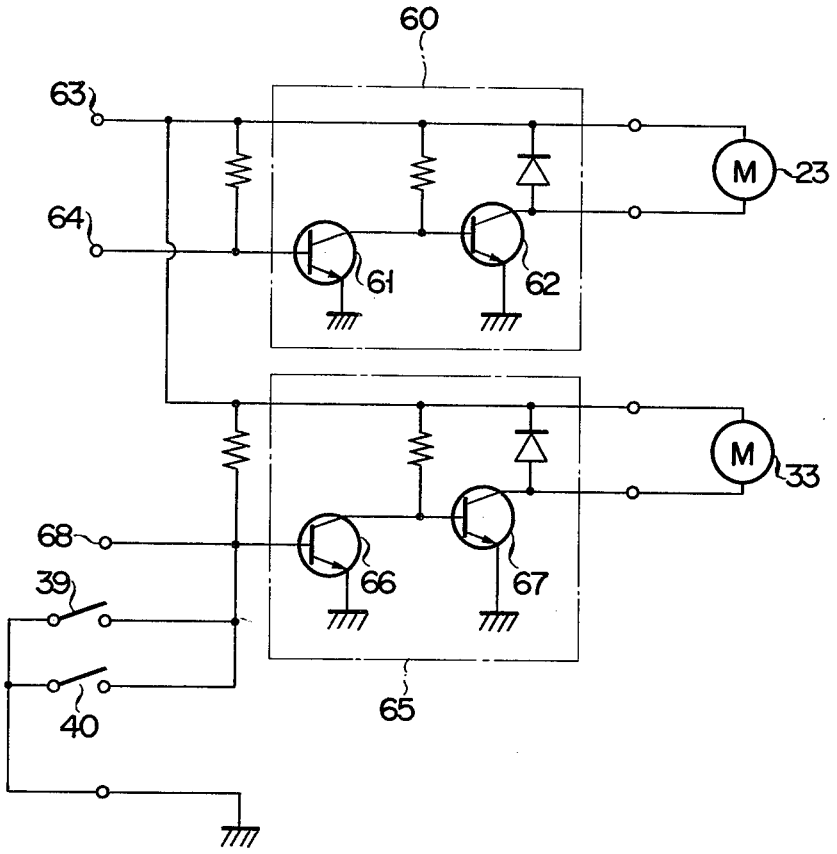

FIG. 4 shows a semiconductor switching circuit including a primary transistor 61 and a secondary transistor 62, whereby a power supply terminal 63 and an input terminal 64 are connected with the head drive motor 23. A semiconductor switching circuit 65 includes a primary transistor 66 and a secondary transistor 67, whereby the power supply terminal 63, an input terminal 68, and the switches 39 and 40 are connected with the motor 33. The input terminals 64 and 68 are supplied with motor control signals from a control section (not shown). Both primary transistors 61 and 66 are normally kept conductive. If input voltage is at zero volts, then the primary transistors 61 and 66 are turned off to allow the secondary transistors 62 and 67 to conduct, thereby applying voltage to the motors 23 and 33. If one of the switches 39 and 40 is closed, therefore, a zero-volt signal is applied to the primary transistor 66 to drive the motor 33, thereby starting automatic paper feeding operation.

Figure 2:
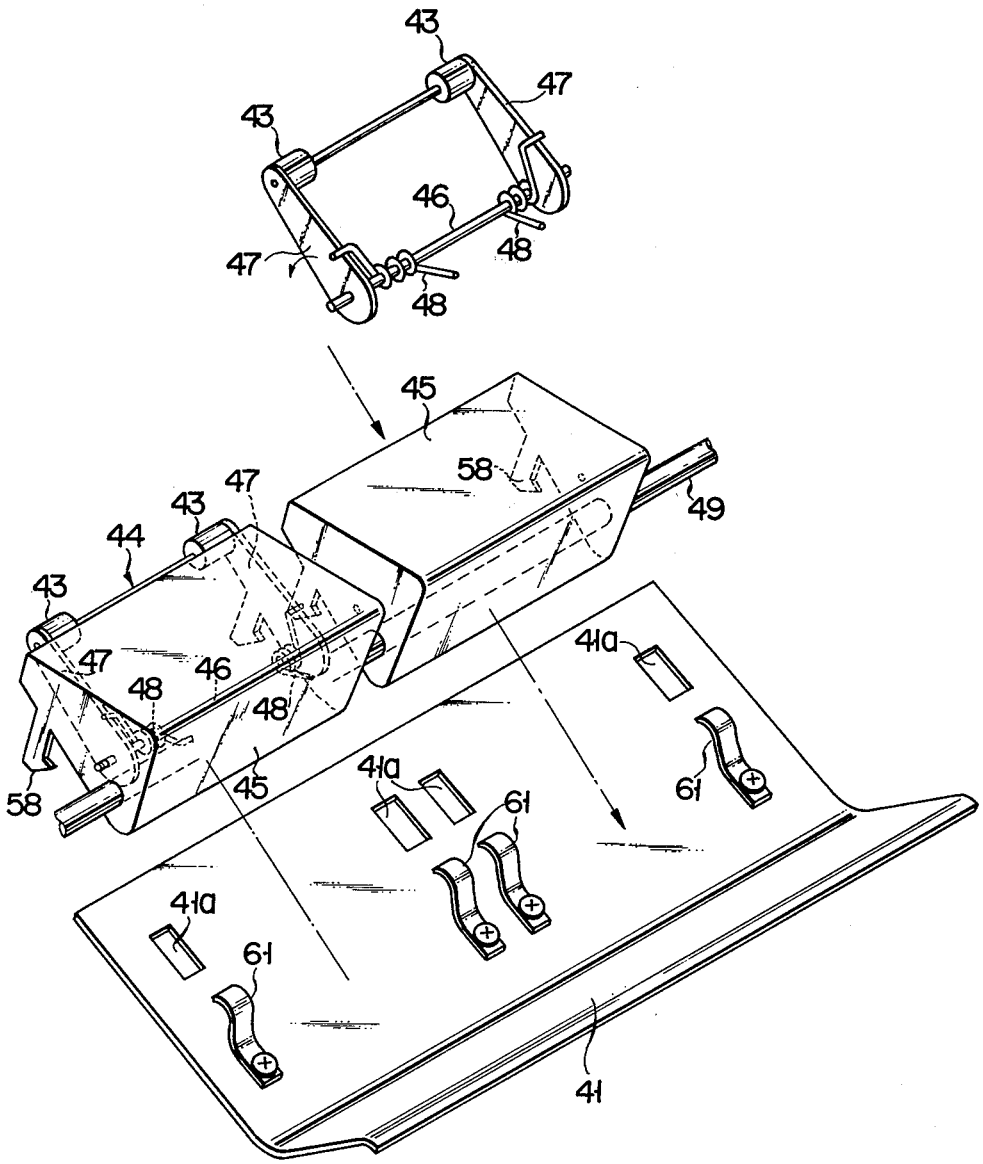

A plate-like discharge guide 41 is disposed, for example, angularly ahead of the platen 21. The guide 41 serves for both receipt and journal blank strips. Feed rollers 42 are independently arranged along a path between the discharge guide 41 and the platen 21. Arranged over the guide 41 are discharge-side pinch roller units 44 each having rolling contact rollers 43 corresponding to the feed rollers 42. The feed rollers 42 and the rolling contact rollers 43 constitute a discharge mechanism for receipt and journal blank strips. Each discharge-side pinch roller unit 44 includes an open-bottomed case 45, a shaft 46 supported in the case 45, and a pair of arms 47 rockably mounted on both end sides of the shaft 46, respectively. The rolling contact rollers 43 of each pinch roller unit are coaxially rotatably supported on a common shaft with a given space between them. Both ends of the common shaft are attached to the respective free ends of the arms 47 which are projected from the case 45. The shaft 46 extends coaxially through middle winding portions of torsion springs 48. The two ends of each spring 48 engage a corresponding arm 47 and the case 45, respectively. Thus, the arms 47 are urged to rock in the direction indicated by an arrow in FIG. 2. Arm stopper portions (not shown) protrude from the inner surfaces of the side walls of the case 45 so that the arms 47 may abut on the stopper portions to be regulated thereby in rocking movement as urged by the springs 48. The cases 45 are arranged side by side and rockably supported on a common shaft 49 which is supported horizontally on the apparatus housing.

As shown in FIG. 3, an output shaft 51 is coupled to the drive shaft 33*a* of the motor 33 by means of a gear train 50. The output shaft 51 is coaxially fitted with clutch bodies 52*a* and 53*a*. Engaging mechanisms 52*b* and 53*b* are arranged near the clutch bodies 52*a* and 53*a* so as to correspond thereto, respectively. The clutch bodies and the engaging mechanisms constitute clutch devices 52 and 53. One clutch device 52 is coupled by means of a gear train 44 to a shaft which supports the discharge-side feed rollers 42 for journal paper. The engaging mechanisms 52*b* and 53*b* are composed of engaging portions $52b_1$ and $53b_1$ pivotally supported at the base ends and facing the clutch bodies 52*a* and 53*a* at the tip ends, springs for urging the engaging portions to rock so that the tip ends of the engaging portions may engage their corresponding clutch bodies, and solenoids $52b_2$ and $53b_2$ which, when excited, cause the engaging portions to rock to the non-engagement position against the urging force of the springs. In the clutch devices 52 and 53, transmission of the rotational force from the motor is stopped when the engaging portions are caused to engage the clutch bodies by the urging force of the springs, and the rotational force is transmitted when the engagement is removed by excitation of the solenoids. Thus, in the latter state, the discharge mechanism for receipt paper is driven by the joint action of the motor 33, the gear train 50, the output shaft 51, the clutch device 52, and the gear train 54, while the discharge mechanism for journal paper is driven by the joint action of the motor 33, the gear train 50, the output shaft 51, the clutch device 53, and the gear train 55.

Each pinch roller unit 44 is held by a lock mechanism 70 so that the feed roller 42 is always in rolling contact with the corresponding rolling contact roller 43. Each lock mechanism 70 comprises an engaged portion 57 pivotally mounted on a pivot 56 at the butt end, an engaging portion 58 extending downward from the case 45, and a spring 59 for urging the engaged portion 57 to rock in one direction so that the tip end of the engaged portion 57 may engage the engaging portion 58. Formed in the discharge guide 41 are escape holes 41*a* for the engaged and engaging portions 57 and 58. One end of an interlocking lever 60 is pivotally mounted on the engaged portion 57 by means of a pin 57*a*. Formed at the other end of the interlocking lever 60 is a longitudinally extending slot in which a pin $35a_1$ is loosely fitted, protruding from the link portion 35*a* of each support member 35. Such coupling allows the supply or discharge mechanism alternatively to activate paper feeding. Attached to the upper surface of the discharge guide 41 are elastic bodies 61 which are intended to keep the rolling contact rollers 43 off the drive rollers 42 when the lock mechanisms 70 release their hold of the pinch roller units. If the pinch roller units are not provided with the cases, then it is necessary only that the engaging portions 58 be attached to the arms 47, and that the elastic bodies 61 be disposed between the arms 47 and the discharge guide 41. Alternatively, the elastic bodies may be attached to the underside of the pinch roller units.

The way that, the receipt blank strip, for example, is set in the apparatus of the construction mentioned above, will now be described. First, the operating portion 36 of the supply mechanism is depressed to rock the support member 35. As a result, the rolling contact roller 30 is pressed against the supply-side feed roller 29, and the switch 39 is pushed by the switch interlocking portion 35*b* and closed. Then, the motor 33 is started by the switching action of the semiconductor switching circuit 65, so that the feed roller 29 is rotated with the aid of the transmission mechanism 34 and the rolling contact roller 30 is also rotated. In this state, if the receipt blank strip is inserted between the rollers 29 and 30 from the blank inlet end of the supply guide 24, the blank strip is automatically fed upward in the supply guide 24. Meanwhile, as the support member 35 is rocked by the pressing force on the operating portion 36, the engaged portion 57 is pulled against the urging force of the spring 59 by the interlocking lever 60. Accordingly, the lock mechanism 70 is released and the pinch roller unit 44 is lifted up by the elastic bodies 61. Thus, after the forward end of the blank strips comes out behind the platen 21, the blank strip can easily be inserted between the discharge-side feed roller 42 and the rolling contact rollers 43 without clogging the discharge mechanism. After the insertion, the pressing force on the operating portion 36 is removed. The pinch roller mechanism 31 is then restored to its original position and the switch 39 is closed to stop the motor 33. Thus, the automatic feeding operation is stopped. Thereafter, the pinch roller unit 44 is manually pushed toward the discharge guide 41 to engage the engaging portions 58 with the engaged portions 57. In other words, the pinch roller unit 44 is held by the lock mechanism 70, and the blank strip is held between the rollers 42 and 43. Thus, the blank strip can very easily be set in the apparatus of this invention which can simultaneously perform automatic paper supply and single-action release of the lock mechanism 70. It is to be understood that the journal blank strip can be set in the same manner. The paper feeding action will cause no trouble because the supply mechanism will ordinarily never feed paper while the discharge mechanism is feeding paper.

What we claim is:

1. A paper guide arrangement for printing apparatus, comprising:

an apparatus housing;

a platen fixedly supported relative to the apparatus housing;

a paper supply guide having an outlet for supplying paper at one side of the platen;

a paper discharge guide having an inlet for discharging the paper from the other side of the platen;

a drive source;

a paper supply drive roller arranged in operative relation with the paper supply guide for rotation by the drive source;

a paper supply contact roller arranged in confronting relation to the paper supply drive roller and first support means for movably supporting the paper supply contact roller into and out of rolling contact with the paper supply drive roller;

a paper discharge drive roller arranged in operative relation with the paper discharge guide for rotation by the drive source;

a paper discharge contact roller arranged in confronting relation to the paper discharge drive roller and second support means for movably supporting the paper discharge contact roller into and out of rolling contact with the paper discharge drive roller; and an operating mechanism including the first and the second support means for controlling the drive source to rotate the paper supply drive roller when the paper supply contact roller is brought by the first support means into rolling contact with the paper supply drive roller, and to stop the rotation of the paper supply drive roller by the drive source when the paper supply contact roller is removed by the first support means from the paper supply drive roller, and wherein the first and the second support means are arranged to cooperate so that the paper discharge contact roller retracts from the paper discharge drive roller when the paper supply contact roller is brought into rolling contact with the paper supply drive roller.

2. The paper guide arrangement according to claim 1, wherein said paper supply guide comprises an upper wall and a lower wall, and said paper supply drive roller and said paper supply contact roller partially project through openings in the walls of the paper supply guide and are brought into rolling contact with each other in said paper supply guide.

3. The paper guide arrangement according to claim 2, wherein said first support means includes an elongate support member pivotally mounted at its middle portion on the apparatus housing, the support member rotatably bearing the paper supply contact roller at one end portion thereof, and having an operating portion at the other end portion thereof for pivoting the support member in response to a pressing force on the operating portion, and including a switch arranged to be closed by the support member to drive said drive source when the operating portion of the support member is actuated so that the paper supply contact roller is brought into rolling contact with the paper supply drive roller.

4. The paper guide arrangement according to claim 3, wherein said operating mechanism includes a spring for urging the rocking member to rock in such a direction that the paper discharge contact roller leaves the paper discharge drive roller, a lock mechanism fixed relative to the apparatus housing for engaging the rocking member and holding the rocking member against the urging force of the spring so that the paper discharge contact roller is brought into rolling contact with the paper discharge drive roller, and a release member connected between the lock mechanism and said support member of the first support means for driving the lock mechanism to release the rocking member when the support member is rocked to bring the paper supply contact roller into rolling contact with the paper supply drive roller.

5. The paper guide arrangement according to claim 1, wherein said second support means includes a rocking member supported for rocking movement on the apparatus housing for rotatably supporting the paper discharge contact roller, the rocking member being movable to bring the paper discharge contact roller into contact with the paper discharge drive roller independently of the position of the paper supply contact roller relative to the paper supply drive roller.

6. The paper guide arrangement according to claim 5, wherein said rocking member is arranged to be moved in response to a manually applied force.

7. A paper guide arrangement according to claim 5, wherein said first support means includes an elongate support member pivotally mounted at its middle portion on the apparatus housing, the support member rotatably bearing the paper supply contact roller at one end portion thereof, and having an operating portion at the other end portion thereof for pivoting the support member in response to a pressing force on the operating portion, and including a switch arranged to be closed by the support member to drive said drive source when the operating portion of the support member is actuated so that the paper supply contact roller is brought into rolling contact with the paper supply drive roller.

* * * * *